US005409442A

United States Patent [19]

Smithwick, Jr.

[11] Patent Number: 5,409,442

[45] Date of Patent: Apr. 25, 1995

[54] ADJUSTABLE-HEIGHT SCORING RULE

[76] Inventor: James M. Smithwick, Jr., 1 Shepard Springs Ct., Durham, N.C. 27713

[21] Appl. No.: 61,806

[22] Filed: May 17, 1993

[51] Int. Cl.[6] ..... B31F 1/08

[52] U.S. Cl. ..... 493/468; 493/471

[58] Field of Search ..... 76/107.8; 493/402, 468, 493/471, 160, 161, 185; 83/879, 886, 887, 698.41, 698.42, 698.51, 698.61

[56] References Cited

U.S. PATENT DOCUMENTS 4,289,492 9/1981 Simpson ..... 493/471
5,194,064 3/1993 Simpson ..... 493/402

FOREIGN PATENT DOCUMENTS 2491-448 4/1982 France ..... 493/468
2491-389 4/1982 France ..... 493/468
3-281236 12/1991 Japan ..... 493/161
2191152 12/1987 United Kingdom ..... 493/468

*Primary Examiner*—Jack W. Lavinder
*Attorney, Agent, or Firm*—Rhodes, Coats & Bennett

[57] ABSTRACT

An adjustable-height scoring rule includes a base member and a plurality of interchangeable scoring inserts which are detachably secured to the base member to adjust the height of the scoring rule. The base member includes insert-receiver for receiving the scoring insert. In one embodiment, the insert-receiver comprises a longitudinally-extending channel formed in the top of the base member. The scoring insert includes an insert portion that fits within the channel of the base member. In a second embodiment, the insert receiving means comprises a longitudinally extending boss, and the scoring insert includes a channel member that engages the boss on the base member.

22 Claims, 4 Drawing Sheets

ADJUSTABLE-HEIGHT SCORING RULE

FIELD OF THE INVENTION

The present invention relates generally to cutting dies for cutting and folding corrugated board and more particularly, to scoring rules used in cutting dies.

BACKGROUND OF THE INVENTION

Rotary cutting dies are widely used for manufacturing boxes, cartons, and interpak-die cuts. The rotary die includes a die cylinder and anvil cylinder mounted in parallel-spaced relation to one another. The cutting die includes a series of cutting rules for shaping a blank, and a series of creasing rules for producing fold lines in the blank where it is to be folded. The anvil cylinder is covered with a blanket of urethane or other resilient material. The cylinders rotate in opposite directions and the board is fed between the cylinders. The cutting die, in cooperation with the anvil cylinder, cuts out a blank from the sheet material and produces fold lines in the blank.

In operation, the size of the nip (the space between the cylinders) is adjusted depending on operating conditions. For example, the blanket surrounding the anvil will be relatively thick when new, but will wear over time. Wear on the blanket will therefore effect the size of the nip which in turn will effect the feed rate of the board passing between the die cylinder and the anvil cylinder. When the blanket is new, there is a tendency for the anvil to feed more board than is desired for each rotation of the anvil. To compensate for the excessive feed, the operator may move the cylinders closer together. Conversely, as the blanket wears, the amount of board fed between the cylinders will decrease. The operator will compensate for inadequate feed by moving the cylinders farther apart.

The adjustments made to compensate for the size of the blanket will also effect score quality. When the cylinders are moved closer together, the creasing rules may produce excessive scores or tend to cut the board. When the cylinders are moved further apart, the creasing rules will produce a light score.

The conditions of the paper will also effect the score quality. For example, when the board is dry, there is a tendency for the board to tear and a lighter score is needed. When the board is wet, it does not cut well and the operator will typically move the cylinders closer to improve the score quality.

In order to maintain a consistent score quality while making adjustments in the nip, it is sometimes necessary to replace the scoring rules with scoring rules of different heights. For example, when the cylinders are moved closer together and the size of the nip is reduced, a shorter scoring rule can be used to prevent excessive scoring and cutting of the board. Similarly, when the cylinders are moved further apart and the size of the nip is increased, a taller scoring rule is needed. Making such changes in the die requires die-makers tools, which are not always available to rotary die operators. Further, it takes a relatively large amount of time to replace scoring rules. This downtime significantly effects the productivity of the rotary die operation.

Accordingly, there is a need for a scoring rule in which the height of the rule can be adjusted relatively quickly by the rotary die operator.

SUMMARY AND OBJECTS OF THE INVENTION

The present invention is an adjustable-height scoring rule which allows the rotary die operator to easily convert the score height of the rule. The adjustable-height scoring rule comprises an elongated base member and a plurality of elongated scoring inserts of varying height. Each scoring insert includes a longitudinally-extending scoring ridge for producing a fold line in a sheet material. The base member includes an insert receiving means for receiving and holding a selected one of the scoring inserts so that the scoring height can be adjusted by interchanging the scoring inserts with one another.

In a first embodiment of the invention, the insert receiving means comprises a longitudinally-extending channel formed in the base member for receiving an insert portion of the scoring insert. The insert portion of the scoring insert includes a longitudinally-extending groove which engages with a longitudinally-extending projection on the channel to retain the scoring insert within the channel.

In a second embodiment of the invention, the insert receiving means comprises a raised boss for mounting the scoring insert to the base member. The scoring insert includes a channel member insertable over the boss on the base member. The boss and the channel member each include interlocking tabs for retaining the channel member on the boss.

The present invention provides an easy and convenient method for the rotary-die operator to adjust the score height. The rotary-die operator simply pries the scoring insert from the base member and replaces it with another scoring insert of different height. The scoring inserts snap on and off the base member so that no die maker's tools are required to change the scoring inserts. Down-time of the rotary die is reduced thereby increasing productivity and decreasing costs of operation.

It is a primary object of the present invention is to provide an easy and convenient method for adjusting the score height of a scoring rule so as to minimize down time and increase productivity of a typical rotary die operation.

Another object of the present invention is to provide a scoring rule having interchangeable scoring inserts for adjusting the score height of the scoring rule.

Other objects and advantages of the present invention will become apparent and obvious from a study of the following description and the accompanying drawings which are merely illustrative of such invention.

DETAILED DESCRIPTION OF THE INVENTION

Figure 1:
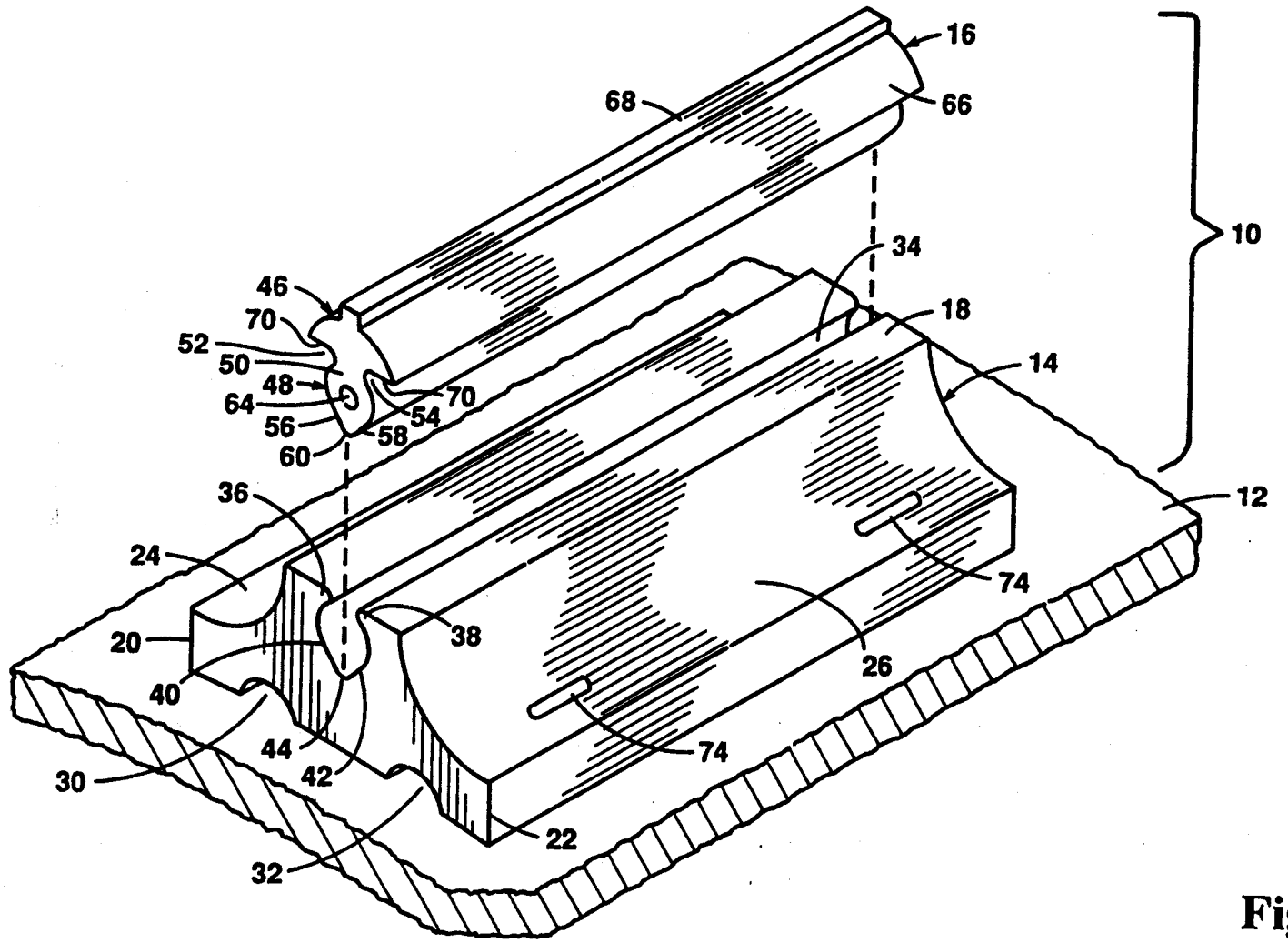
FIG. 1 is a perspective view of the adjustable-height scoring rule of the present invention.

Referring now to the drawings, and particularly to FIG. 1, the scoring rule of the present invention is shown therein and indicated generally by the numeral 10. The scoring rule 10 is a surface rule which is adapted to be mounted to the surface of the die board indicated generally at 12. The scoring rule 10 includes an elongated base member 14 and a scoring insert 16.

The base member 14 is extruded from aluminum or a high molecular weight plastic such as polyethylene. The base member 14 includes a top surface 18 and a pair of flanges 20, 22 which extend outwardly in opposite directions. The top surface 18 is joined with the flanges by curved surfaces 24 and 26.

A pair of shallow, longitudinally-extending grooves 30, 32 are located on the bottom 28 of the base member 14. The grooves 30, 32 are symmetrically disposed with respect to the center line of the base member. The purpose of the grooves 30, 32 is to minimize the cross-sectional area of the base member 14 to (1) allow the base member 14 to conform more easily to a curved surface, and (2) reduce the material in base member 14.

A channel 34 is formed in the top 18 of the base member 14. The channel 34 extends longitudinally along the center line of the base member 14. A pair of inwardly projecting shoulders 36, 38 are disposed on opposite sides of the channel for retaining the scoring inserts 16 within the channel 34 as will be hereinafter described. The channel 34 has a generally diamond-shaped configuration. The widest point of the channel occurs immediately below the shoulders 36, 38. From this point, the sides 40, 42 of the channel converge and meet at the bottom 44.

The scoring insert 16 is preferably made of a high molecular weight plastic, such as polyethylene. The scoring insert 16 includes a crown portion 46 and an insert portion 48. The insert portion 48 has a diamond-shaped configuration which corresponds to the configuration of the channel 34 and is compressible. The insert portion 48 is joined to the crown portion 46 by a narrow neck 50. A pair of shallow grooves 52, 54 are formed on opposite sides of the neck which are engaged by the shoulders 36, 38 of the base member 14 to retain the scoring insert 16 within the channel 34. The insert portion 48 includes a pair of converging surfaces 56, 58 which meet at the tip 60. A longitudinally extending opening 64, which extends the length of the scoring insert 16, is preferably formed in the center of the insert portion 48. The inclined surfaces 56, 58 in conjunction with the longitudinal opening 64 allows the insert portion 48 to be compressed between the shoulders 36 and 38 of the base member 14 when it is inserted into the channel 34.

The crown portion 46 includes a generally rounded top surface 66. A scoring ridge 68 extends longitudinally along the center of the top surface 66. The function of the scoring ridge 68 is to engage the corrugated board or other sheet material to form a crease or fold line in the sheet material. The underside 70 of the crown portion is adapted to engage the top surface 18 of the base member 14 on either side of the channel 34.

Figure 2:
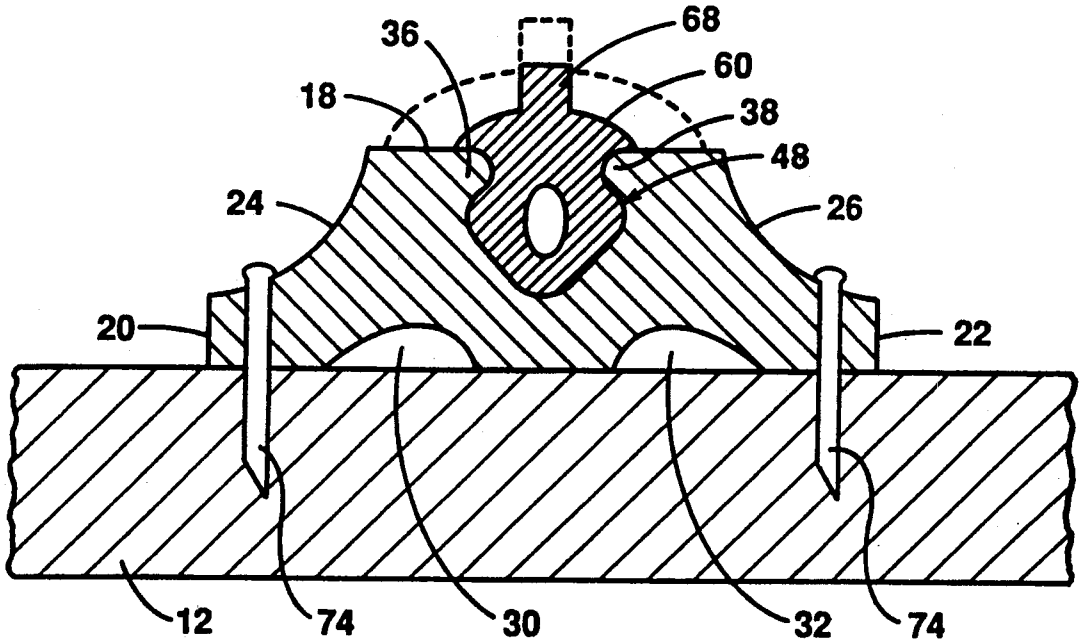
FIG. 2 is a cross-section of the adjustable-height scoring rule of the present invention.

In use, the base member 14 is secured to the die board 12 by staples 74. A scoring insert 16 of appropriate size is then inserted into the channel 34 by pressing the insert portion 48 of the scoring insert 16 into the channel 34. In the event that the height of the scoring rule 10 needs to be changed, the scoring insert 16 can be pulled out of the channel 34. After removing the scoring insert 16, another scoring insert 16 having a larger or smaller crown 46 can be inserted in its place as clearly shown in FIG. 2.

Figure 3:
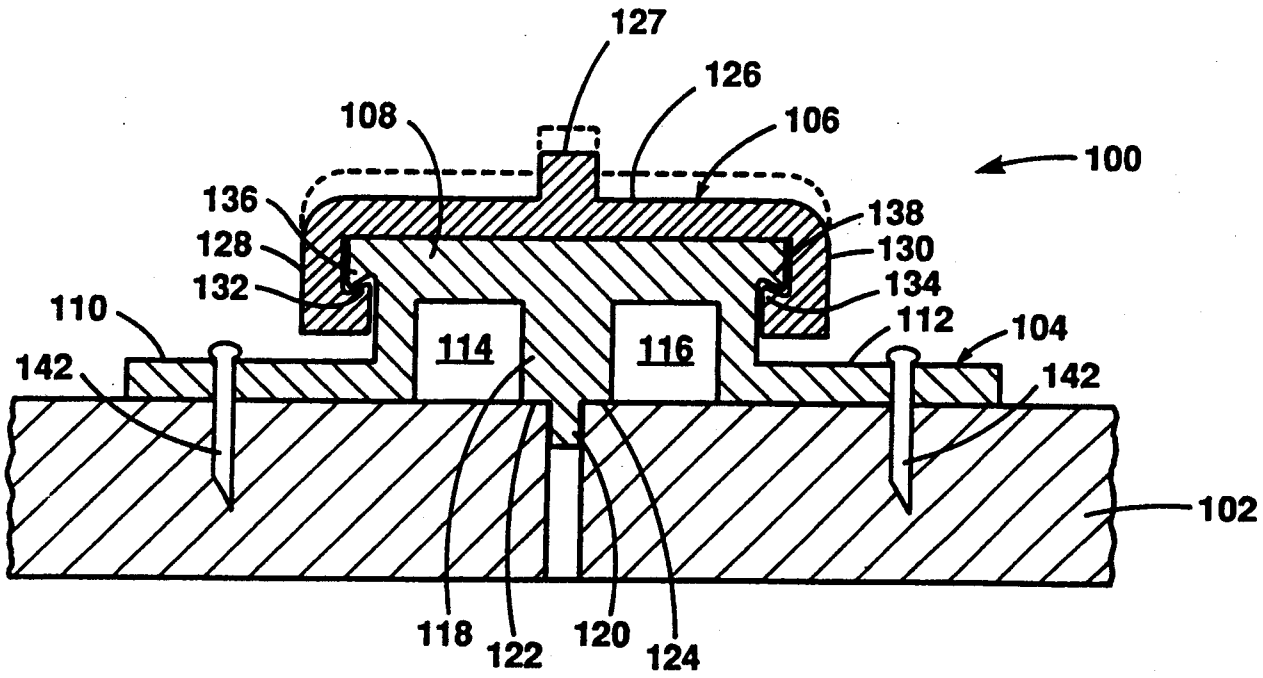
FIG. 3 is a cross-section of a second embodiment of the adjustable-height scoring rule of the present invention.

Referring now to FIG. 3, a second embodiment of the scoring rule is shown and indicated generally by the numeral 100. The embodiment shown in FIG. 3 includes a base member 104 and a scoring insert 106. The base member 104 is adapted to be mounted to the surface of a die board 102. The base member 104 includes a raised boss 108 and a pair of outwardly extending flanges 110, 112 extending in opposite directions from the boss 108.

The boss 108 has a pair of channels 114, 116 formed in the underside thereof. The channels 114, 115 are separated by a partition wall 118. A tongue 120 extends downwardly from the partition wall 118 which is adapted to fit in a groove in the die board 102. A pair of shoulders 122, 124 are disposed on opposite sides of the tongue on the bottom of the partition wall 118.

The scoring insert 106 in the second embodiment is in the form of a U-shaped channel member 126 which fits over boss 108. The channel member 126 includes a longitudinally-extending scoring ridge 127 formed on the top side thereof. At the lower end of each channel wall 128, 130, there is formed an inwardly projecting tab 132, 134. The boss 108 is formed with tabs 136, 138 on either side thereof which engage the tabs 132, 134 on the scoring insert 106.

In use, the base member 104 is secured to the die board 102 by staples 142 which pass through the flanges 110 and 112. The base member 104 is located by inserting the tongue 120 into a respective groove in the die board 102. After the base member 104 is secured in place, a scoring insert 106 of appropriate size is attached to the base member 104. The scoring insert 106 is pressed onto the boss 108. The channel walls 128, 130 must have sufficient flexibility to bend outwardly when the insert 106 is pressed onto the boss 108 and sufficient resiliency to return to their original position when the channel member 126 engages to top surface of the boss 108.

If it is desired to change the height of the scoring rule 100, the scoring insert 106 is removed by prying it from the base member 104 or, if circumstances permit, sliding it lengthwise. Once the scoring insert 106 is removed, another scoring insert 106 having a thicker or thinner web 126 can be inserted in its place as shown by the dotted lines in FIG. 3.

Figure 4:
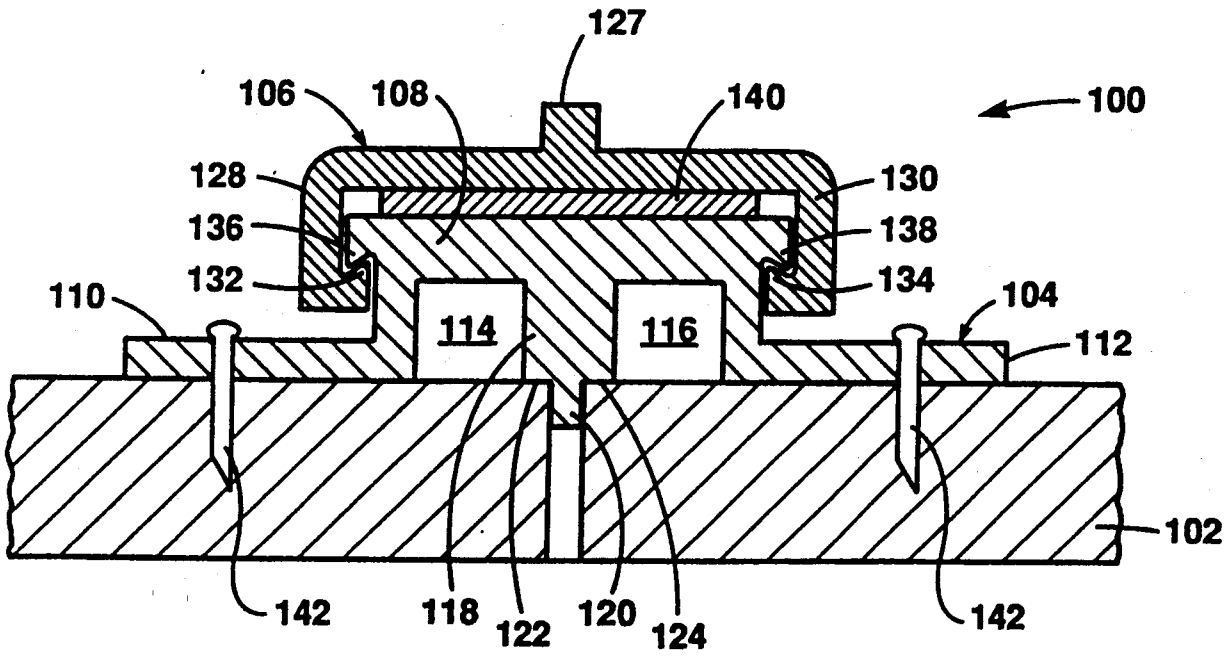
FIG. 4 is a cross-section view of the adjustable-height scoring rule of FIG. 3 showing the use of a shim to adjust the score height.

Referring now to FIG. 4, an alternate method for varying the height of the scoring rule of FIG. 3 is shown. Rather than replacing the scoring insert 106 with a separate scoring insert of different size or thickness, the scoring height is changed by inserting a shim 140 between the channel member 126 and the top of the boss 108. This method could be used to provide a variety of score heights using a single scoring insert 106.

By using a replaceable scoring insert 106 which is easily attached to a base member, the present invention allows the rotary die operator to easily and conveniently make changes in the scoring height as operating conditions warrant. Changes in scoring height can be made relatively rapidly without special die-makers tools. Thus, down-time is reduced and productivity is increased.

What is claimed is:

1. An adjustable-height scoring rule kit comprising:

(a) an elongated base member;

(b) a plurality of elongated scoring inserts, each of said scoring inserts including a longitudinally extending ridge for producing a fold line in a sheet material; and (c) insert receiving means formed on said base member for receiving and releasibly holding a selected one of said scoring inserts such that the scoring height can be adjusted by interchanging said scoring inserts.

2. The adjustable-height scoring rule kit of claim 1 wherein the insert receiving means includes a longitudinally-extending channel formed in the base member for receiving the scoring insert.

3. The adjustable-height scoring rule kit of claim 2 wherein the scoring insert includes an insert portion insertable into the channel in the base member.

4. The adjustable-height scoring rule kit of claim 3 wherein the insert portion of the scoring insert includes a recess and wherein the channel includes a projecting member for engaging the recess in the scoring insert to secure the scoring insert within the channel.

5. The adjustable-height scoring rule kit of claim 4 wherein the recess comprises a longitudinally-extending groove and wherein said projecting member comprises a longitudinally extending shoulder.

6. The adjustable-height scoring rule kit of claim 5 wherein the insert portion of the scoring insert includes a longitudinally extending opening to facilitate insertion of the scoring insert into the channel of the base member.

7. The adjustable-height scoring rule kit of claim 1 wherein the insert-receiving means comprises a raised boss for mounting the scoring insert to the base member.

8. The adjustable-height scoring rule kit of claim 7 wherein the scoring insert includes a channel member insertable over the boss on the base member.

9. The adjustable-height scoring rule kit of claim 8 wherein the boss extends longitudinally along the base member.

10. The adjustable-height scoring rule kit of claim 9 wherein the boss and the channel member include interlocking tabs for retaining the channel member on the boss.

11. The adjustable-height scoring rule kit of claim 1 wherein the base member includes a pair of longitudinally-extending flanges along each edge and wherein the flanges extend outwardly from the base member in opposite directions.

12. The adjustable-height scoring rule kit of claim 1 wherein the base member includes a locating member projecting downwardly from the bottom of the base member for locating the base member with respect to an underlying support.

13. The adjustable-height scoring rule kit of claim 1 wherein the base member includes at least one longitudinally extending relief formed in the bottom of the base member.

14. An adjustable-height scoring rule kit comprising:

(a) an elongated base member having a longitudinally extending channel formed therein;

(b) a plurality of variable height interchangeable scoring inserts insertable into the channel in the base member to adjust the height of the scoring rule; and (c) each of the scoring inserts including an insert portion adapted to be received in the channel of the base member and a crown portion projecting upwardly from the channel in the base member, said crown portion having a longitudinally extending scoring ridge of a predetermined height.

15. The adjustable-height scoring rule kit of claim 14 wherein the insert portion of the scoring insert includes a recess and wherein the base member includes a projecting member for engaging the recess in the scoring insert to secure the scoring insert within the channel.

16. The adjustable-height scoring rule kit of claim 15 wherein the recess comprises a longitudinally-extending groove and wherein said projecting member comprises a longitudinally-extending shoulder formed adjacent the channel.

17. The adjustable-height scoring rule kit of claim 16 wherein the insert portion of the scoring insert includes a longitudinally-extending opening to facilitate insertion of the scoring insert into the channel of the base member.

18. An adjustable-height scoring rule kit comprising:

(a) an elongated base member having a longitudinally extending, raised boss;

(b) a plurality of interchangeable scoring inserts for adjusting the scoring height, each of the scoring inserts including a longitudinally-extending channel member insertable over the boss on the base member, and including a longitudinally-extending scoring ridge for producing a fold line in a sheet material.

19. The adjustable-height scoring rule kit of claim 18 wherein the raised boss on the base member and the channel member include interlocking tabs for retaining the channel member on the boss.

20. The adjustable-height scoring rule kit of claim 18 wherein the base member includes a pair of longitudinally-extending flanges along each side of the boss and wherein the flanges extend outwardly from the boss in opposite directions.

21. The adjustable-height scoring rule kit of claim 18 wherein the base member includes a locating member projecting downwardly from the bottom of the base member for locating the base member with respect to an underlying support.

22. The adjustable-height scoring rule kit of claim 18 wherein the base member includes at least one longitudinally-extending relief formed in the bottom of the base member.

* * * * *